US006800024B1

(12) United States Patent
Prevost

(10) Patent No.: US 6,800,024 B1
(45) Date of Patent: Oct. 5, 2004

(54) VENT TERMINATION RECEPTACLE WITH DAMPER

(76) Inventor: Leon Prevost, 12615-124 Street, Edmonton, Alberta (CA), T5L 0N8

( * ) Notice: Subject to any disclaimer, the term of this patent is extended or adjusted under 35 U.S.C. 154(b) by 0 days.

(21) Appl. No.: 10/056,066

(22) Filed: Jan. 28, 2002

(51) Int. Cl.[7] ..... F24F 13/08

(52) U.S. Cl. ..... 454/290; 251/310; 454/324; 454/334

(58) Field of Search ..... 454/76, 284, 290, 454/322, 324, 334; 251/309, 312, 209, 310

(56) References Cited

U.S. PATENT DOCUMENTS

| | | | | | |
|---|---|---|---|---|---|
| 141,601 | A | * | 8/1873 | Skinner | 126/312 |
| 2,270,907 | A | * | 1/1942 | Slade | 454/284 |
| 3,727,539 | A | * | 4/1973 | Wilmes | 454/324 |
| 4,513,655 | A | | 4/1985 | Dayus | |
| 4,628,954 | A | | 12/1986 | Dayus | |
| 4,653,725 | A | | 3/1987 | Nanz et al. | |
| 5,411,438 | A | | 5/1995 | White et al. | |
| 5,806,830 | A | | 9/1998 | Alvarez | |
| 5,813,430 | A | | 9/1998 | De Leon | |
| 5,857,617 | A | | 1/1999 | Weng | |
| 5,921,277 | A | | 7/1999 | Bernal | |
| 5,938,525 | A | * | 8/1999 | Birdsong et al. | 454/290 |
| 6,082,704 | A | | 7/2000 | Grinbergs | |

FOREIGN PATENT DOCUMENTS

| | | | | |
|---|---|---|---|---|
| NL | 99432 | * | 10/1961 | 251/312 |

* cited by examiner

*Primary Examiner*—Harold Joyce
(74) *Attorney, Agent, or Firm*—Adrian D. Battison; Michael R. Williams; Ryan W. Dupuis

(57) ABSTRACT

A high pressure air supply duct is terminated by a termination receptacle defining a cylindrical housing with an inlet pipe connected to the duct and generally at right angles to the axis. The housing has one end closed and a mounting flange member at the open end for attachment of the housing to a mounting surface. A generally cylindrical damper sleeve has an open discharge end connected to a vent plate and an insertion portion extending to the bottom of the housing for receiving the air therefrom. The vent plate has a plate portion with a central perforated discharge area which is perforated for the passage of air therethrough and a peripheral surrounding flange and can be rotated about the axis of the housing to rotate the damper sleeve. The damper sleeve has a projecting notch engaging into a slot in the housing to hold it in place. The bottom end of the sleeve is smoothly curved to guide the air to turn from the smaller inlet pipe into the larger housing where it can expand as it passes to the vent plate. The insertion portion of the damper sleeve member is shaped with a cut out to co-operate with the circular cylindrical portion of the housing to move gradually between a first position in which the opening is fully exposed by cut out in the insertion portion allowing passage of air from the inlet through the full area of the opening into the housing and a second position in which the cut out is turned and the insertion portion fully covers the opening thus closing off flow of air through the opening into the housing such that the insertion portion acts as a damper.

22 Claims, 6 Drawing Sheets

VENT TERMINATION RECEPTACLE WITH DAMPER

FIELD OF THE INVENTION

This invention relates to vent termination receptacle with an integral damper.

BACKGROUND

In the construction of HVAC systems, a central air handler delivers air to the interior of the structure through a main plenum duct, and a series of branch ducts which terminate at a vent termination receptacle which attaches to a vent plate for controlling the discharge of air into the space. With a higher pressure air system, the vent termination receptacle includes a housing which is preferably of greater cross sectional area than the supply duct so that the air leaving the ductwork at the vents expands rapidly as it enters the housing and creates a lower air pressure zone around the vent. This is a practical application of Bernoulli's theorem and the Venturi effect. One of the problems of higher pressure air systems (commonly known as Hi-Velocity systems) is that conventional damper assemblies such as those described in U.S. Pat. Nos. 4,513,655, 4,628,954, 4,653,725, 5,411,438, 5,806,830, 5,813,430, 5,857,617, 5,921,277, and 6,082,704 will cause air noise.

In the history of these Hi-Velocity style systems, no damper has been truly effective without causing noise.

SUMMARY

It is one object of the present invention, therefore, to provide an termination receptacle for an air supply duct which includes an integral damper operable by the user to vary or shut off the air flow through the duct.

According to a first aspect of the invention, therefore, there is provided a termination receptacle for an air supply duct comprising:

- a housing having a wall surrounding an axis of the housing;
- an inlet pipe arranged for connection to the air supply duct for receiving air therefrom;
- the inlet pipe being connected to the wall of the housing generally at right angles to the axis so as to communicate the air from the duct through an opening in the wall into the housing;
- the housing having one end closed and an opposed open end such that the air supplied into the housing passes from the housing through the open end;
- the housing having a mounting flange member at the open end for attachment of the housing to a mounting surface such that the axis is generally at right angles to the mounting surface;
- a damper sleeve member having an open discharge end and an insertion portion extending from the discharge end and arranged for insertion into the open end of the housing for receiving the air therefrom
- the wall of the housing defining at least a portion thereof at the opening which is circular cylindrical at least partly surrounding the axis;
- the insertion portion of the damper sleeve member being arranged rotate around the axis and being shaped to cooperate with the circular cylindrical portion of the housing to move gradually between a first position in which the opening is fully exposed by the insertion portion allowing passage of air from the inlet through the full area of the opening into the housing and a second position in which the insertion portion fully covers the opening thus closing off flow of air through the opening into the housing such that the insertion portion acts as a damper.

Preferably the vent plate itself forms a part of the combination and is attached to the damper sleeve member or is formed as an integral component with the damper sleeve member so that the damper sleeve member is rotated about the axis by the user rotating the vent plate about the axis.

Thus according to a second aspect of the invention there is provided a termination receptacle for an air supply duct comprising:

- a housing having a wall surrounding an axis of the housing;
- an inlet pipe arranged for connection to the air supply duct for receiving air therefrom;
- the inlet pipe being connected to the wall of the housing-generally at right angles to the axis so as to communicate the air from the duct through an opening in the wall into the housing;
- the housing having one end closed and an opposed open end such that the air supplied into the housing passes from the housing through the open end;
- the housing having a mounting flange member at the open end for attachment of the housing to a mounting surface such that the axis is generally at right angles to the mounting surface;
- a damper sleeve member having an open discharge end and an insertion portion extending from the discharge end and arranged for insertion into the open end of the housing for receiving the air therefrom
- a vent plate member;
- the vent plate member having a plate portion with a central perforated discharge area which is perforated for the passage of air therethrough and a peripheral surrounding flange;
- the vent plate member having a projecting connecting portion extending from the plate portion generally at right angles to the plate portion for connecting the vent plate member to the damper sleeve member at the open end thereof for communication of the air from the housing through the damper sleeve member and through the central perforated discharge area;
- the connecting portion and the damper sleeve member being arranged such that the vent plate member is maintained attached thereto with the plate portion generally at right angles to the axis so as to lie parallel to the mounting surface on a side thereof opposite to the mounting flange member;
- the connecting portion and the damper sleeve member being arranged such that rotation of the vent plate member about the axis causes common rotation of the damper sleeve member about the axis therewith;
- the wall of the housing defining at least a portion thereof at the opening which is circular cylindrical at least partly surrounding the axis;
- the insertion portion of the damper sleeve member being arranged rotate around the axis with rotation of the damper sleeve member and being shaped to cooperate with the circular cylindrical portion of the housing to move gradually between a first position in which the opening is fully exposed by the insertion portion allowing passage of air from the inlet through the full area of the opening into the housing and a second position in which the insertion portion fully covers the opening thus closing off flow of air through the opening into the housing such that the insertion portion acts as a damper.

Preferably the insertion portion includes a circular cylindrical wall portion at the circular cylindrical portion of the housing. It is not necessary for either portion to form a complete cylinder surrounding the axis since the cylindrical portions need only extend sufficiently around the axis to allow the movement through roughly ninety degrees between the two positions. The remainder of the portions can then differ from the cylindrical shape so long as they do not interfere with the movement.

Preferably the insertion portion has an outer surface in sliding fit with an inner surface of the circular cylindrical portion of the housing. In this case one or both of the portions in sliding fit is formed of plastics material so as to ensure a close fit and a sealing action.

Preferably the insertion portion is substantially circular cylindrical in shape with a cut out at the opening so that the cut out is provided only at the opening and has side edges parallel to the axis.

Preferably the insertion portion extends substantially to the bottom of the housing.

Preferably the inlet pipe is of smaller cross-sectional area than the housing so as to allow expansion of the air as it enters the housing, although this is not essential to the operation.

Preferably the vent plate member and the damper sleeve member are separate and connected by cooperating elements arranged to allow adjustment of the angular position of the vent member relative to the damper sleeve member. Alternatively the vent plate and sleeve can be integral. Alternatively the vent plate and the sleeve can be separate and the sleeve rotatable independent of the vent plate so that the vent plate remains at a fixed position relative to the mounting surface while the sleeve can be rotated by the user by a suitable lever.

Preferably the damper sleeve member includes an interconnecting element for holding the damper sleeve member in the housing to prevent it from falling out in the event that the housing in installed up side down in a ceiling or in the event that the housing is installed with the axis horizontal.

Preferably the housing has a depth between the flange member and the bottom which is no greater than 3.5 inches thus allowing the housing to be installed in the space between conventional two by four studs. However larger or smaller sizes can also be used and the construction is not in any way size specific.

Preferably the damper sleeve member includes two axially spaced cylindrical portions defining a shoulder therebetween.

Preferably the damper sleeve member includes an outwardly projecting tab on an outer surface thereof for projecting into an annular locating slot on the housing, which acts to hold the sleeve in place and also acts to limit the angular movement of the sleeve around the axis.

Preferably the vent plate member and the damper sleeve member are separate and connected by cooperating elements which comprise longitudinally extending ribs and grooves.

Preferably the insertion portion of the damper sleeve member includes a closed end at the closed end of the housing. In this arrangement, the closed bottom end is preferably shaped to provide a smooth curved guide surface at the opening to guide air from the inlet pipe to turn through ninety degrees to flow axially along the housing.

Since having the ability to shut off vents by the end user is desirable, the configuration is provided in the embodiment as described hereinafter in which the velocity and pressure relationship of the airflow is altered sufficiently to allow for a damper that causes minimal noise and minimal air leakage.

This arrangement as described hereinafter provides a vent termination receptacle with integral damper for the Heating, Ventilation, Air Conditioning (HVAC) Industry, particularly for higher pressure air systems. Normally the vent plate has vanes which are simply straight so as to have no effect on the direction of the air flow. However in some cases it may be desirable to provide directional vanes in which case the vent plate can be installed, by rotating the vent plate relative to the sleeve, with the airflow pointing in any direction needed by the application.

An injection molded plastic, two piece vent boot and damper assembly as described hereinafter provides a simple, effective, and economic solution to this problem. The benefits of a plastic assembly are an inherent sound acoustic property greater than that of metal assemblies, as well as a resistance to mal-forming, moisture, mold, and rust.

Air leakage around vanes or flaps that is minimal with lower air pressure systems, is greatly amplified with Hi-Velocity systems, so a tight fit, easily reproducible assembly, as described hereinafter is provided. To further compound the design problem, it is desirable that the entire assembly is small enough to fit in a standard construction 2×4 stud wall to allow for sidewall discharge of the air.

The housing preferably has a barrel with a diameter larger than that of the branch ductwork causes a change in the pressure to velocity ratio of the airflow, which helps minimize a noise increase easily experienced with higher pressure air terminations. The damper sleeve which snugly turns inside this barrel, allows for a closure of the airflow without the "whistling" experienced from conventional dampening methods. A matching groove and lip on the two pieces further reduces air leakage while also preventing the damper tube from falling out of place when the assembly is installed in a ceiling pointing downward.

BRIEF DESCRIPTION OF THE DRAWINGS

In the accompanying drawings, which illustrate an exemplary embodiment of the present invention.

DETAILED DESCRIPTION

Figure 1:
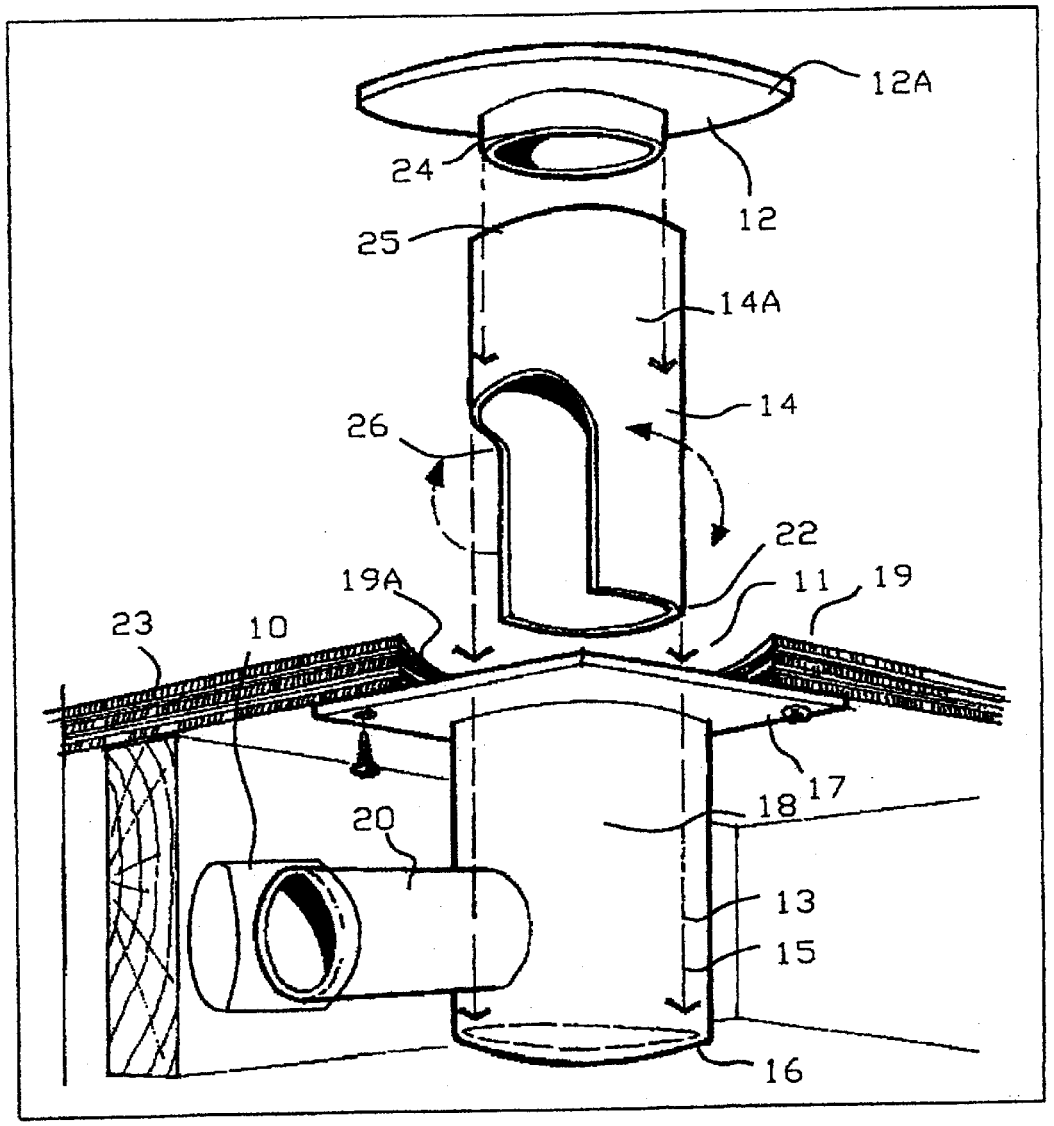
FIG. 1 is an isometric view showing a first embodiment of the invention.
Figure 2:
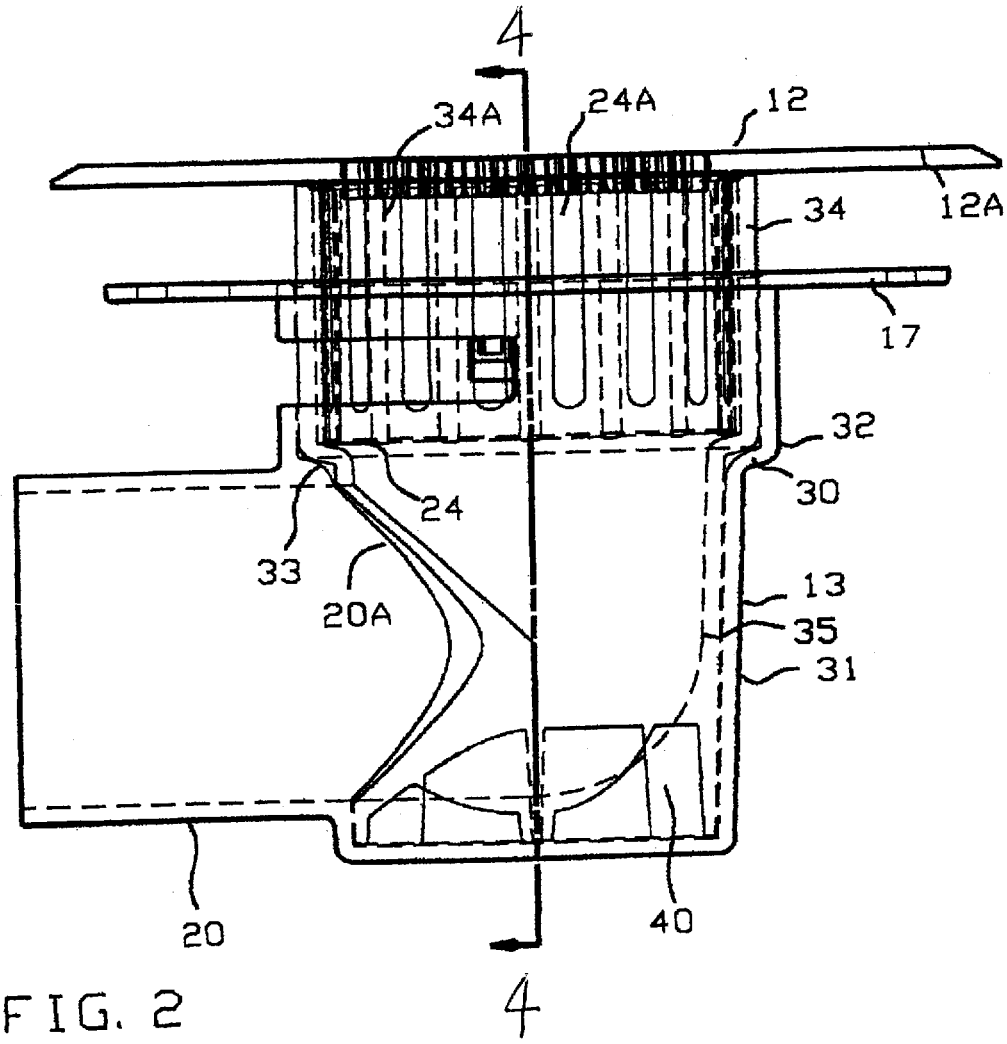
FIG. 2 is a side elevational view partly in phantom of a second embodiment of the invention.
Figure 3:
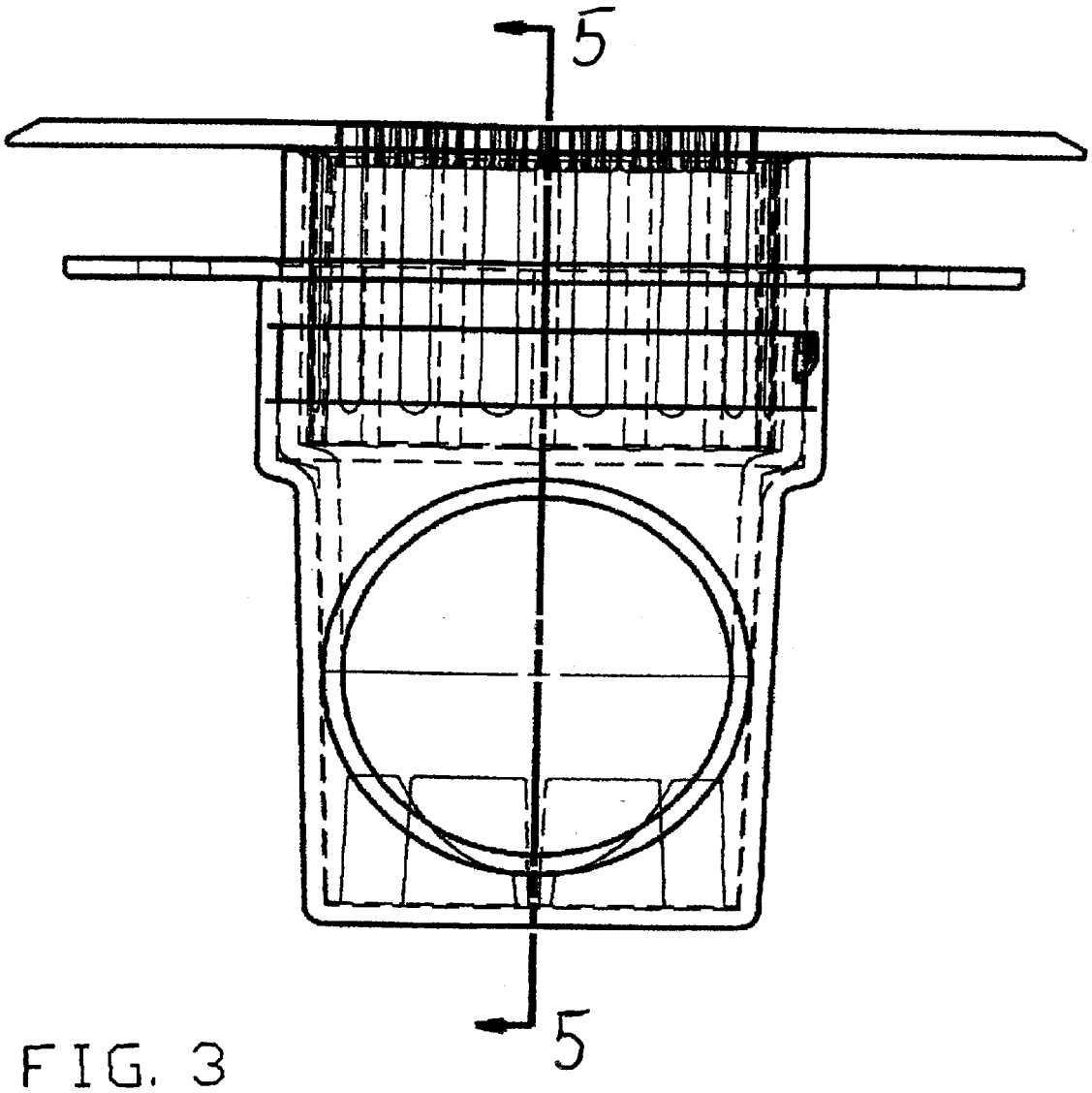
FIG. 3 is a front elevational view partly in phantom of the second embodiment of the invention.

In FIG. 1 is shown a first embodiment of the invention in a simplified shape and form which shows the principle of operation of the device.

The duct system from a central air source (not shown) provides a branch duct 10 communicating to a termination receptacle generally indicated at 11 which co-operates with a vent plate 12. The termination receptacle is formed in two pieces including a housing 13 and a damper sleeve 14.

The housing 13 forms a generally cylindrical wall 15 with a closed bottom end 16 and an open top end. At the top end is provided a peripheral flange 17 which as shown is square in plan view but can be circular or can be formed simply by a plurality of tabs with the flange lying in a plane which is at right angles to the longitudinal axis 18 of the cylindrical housing 13. The flange 17 is attached to the underside of a floor 19 forming a mounting surface for the housing.

In the alternative the flange can be mounted on the inside surface of a sheathing material forming a wall surface or on the top surface of a sheathing material forming a ceiling. Thus the housing is held in place in a fixed position with the axis 18 at right angles to the duct 10.

An inlet pipe 20 is connected to the duct 10 by suitable connection system and is formed as an integral structure with the housing providing an opening between the end of the inlet pipe and the interior of the housing. The inlet pipe is circular in cross section so that the opening is also circular and extends through the cylindrical wall 15 to the hollow interior of the housing. The inlet pipe is of smaller cross sectional area and thus smaller diameter than the housing 13 so that air entering the housing from the inlet pipe expands and slows in a conventional manner used in high pressure systems of this type.

The damper sleeve member 14 forms a generally cylindrical shape having an outer surface 14A which co-operates with an inner surface of the cylindrical wall 15 of the housing in a sliding fit so that the damper sleeve can rotate around the axis 18 within the housing 15. A bottom edge 22 of the sleeve extends to the bottom of the housing to a position below the inlet pipe so as to extend to a portion of the housing beyond the bottom of the inlet pipe.

The longitudinal extent of the housing from the base 16 to the flange 17 is 3.5 inches in length so that it can fit underneath the floor sheeting 19 and between the floor support studs 23 of a conventional 2×4 dimension.

The vent plate 12 includes a central area (not visible) which is perforated with vent openings to allow air from the housing to escape through the vent plate into the space above the floor sheathing. Around the central discharge area of the vent plate is provided a flange section 12A which covers an opening 19A in the floor sheathing so as to provide an attractive appearance for the discharge vent of the air supply system. On the back of the vent plate is provided a collar 24 which inserts into an upper discharge end 25 of the cylindrical sleeve 14A as a tight fit. The angular orientation of the vent plate relative to this sleeve can be adjusted by pulling the collar from the sleeve and rotating the vent plate relative to the sleeve and reinserting the collar into the sleeve at the required angular orientation. When inserted the collar is held in place within the end of the sleeve by suitable projections such as a peripheral rib which frictionally engages the sleeve to hold the vent plate attached to the sleeve. Thus manual rotation of the vent plate causes similar rotation of the sleeve about the axis 18 within the housing 13.

The sleeve includes a cut-out 26 with a curved top edge 26A and two vertical sides 26B and 26C each parallel to the axis 18. When the cut-out is thus aligned with the inlet opening of the inlet pipe 20, air can flow from the inlet pipe into the hollow interior of the housing that is within the hollow interior of the sleeve since the sleeve is a close fit on the inside of the housing. However when the sleeve is rotated relative to the housing one of the edges 26B or 26C crosses over into the area of the opening of the inlet thus cutting off a portion of the area of the opening to reduce the amount of air flow through the inlet pipe into the housing. When rotated through an angle of the order of 90°, the sleeve fully covers the opening of the inlet pipe to prevent air passage into the housing thus closing off that particular duct 10.

The damper sleeve thus provides a simple technique for closing off the duct 10 or for reducing air flow through the duct 10 simply by rotating the vent plate. The tight fit of the sleeve within the housing prevents or significantly reduces the passage of air around or through gaps in the system so that there is little noise or whistling effect due to the high pressure flow. When fully closed by the sleeve being turned, the opening of the inlet pipe is fully closed by the outside surface of the sleeve and the escape of air around the opening into the space between the sleeve and the housing is prevented or inhibited by the close tolerances between the surfaces and by the fact that the closure is formed not by a simple edge but by portions of the outside and inside surface respectively of the sleeve and housing.

In the embodiment shown in FIG. 1, the housing can be formed of metal in conventional manner and the sleeve formed from plastics material so as to provide a reduction in friction between the outside surface of the sleeve and the inside surface of the housing. Alternatively both pieces can be formed from molded plastics material.

Turning now to the second embodiment shown in the remaining figures, the principle of operation as previously described is identical except that the parts are molded to provide particular co-operating shapes by injection molding from a suitable plastics material. Thus the inlet pipe 20 leading to the opening 20A in the housing 13 is formed as an integrally molded structure with the housing. Further, the housing is molded to define a shoulder 30 between two cylindrical portions 31 and 32 so that the shoulder co-operates with a corresponding shoulder 33 formed on the sleeve between two cylindrical portions 34 and 35. The position of the shoulder co-operates with or is located at the bottom end of the collar 24 of the vent plate 12. Thus the sleeve can be inserted until the shoulder 33 sits on the shoulder 30 so as to locate the depth of the sleeve within the housing.

Figure 4:
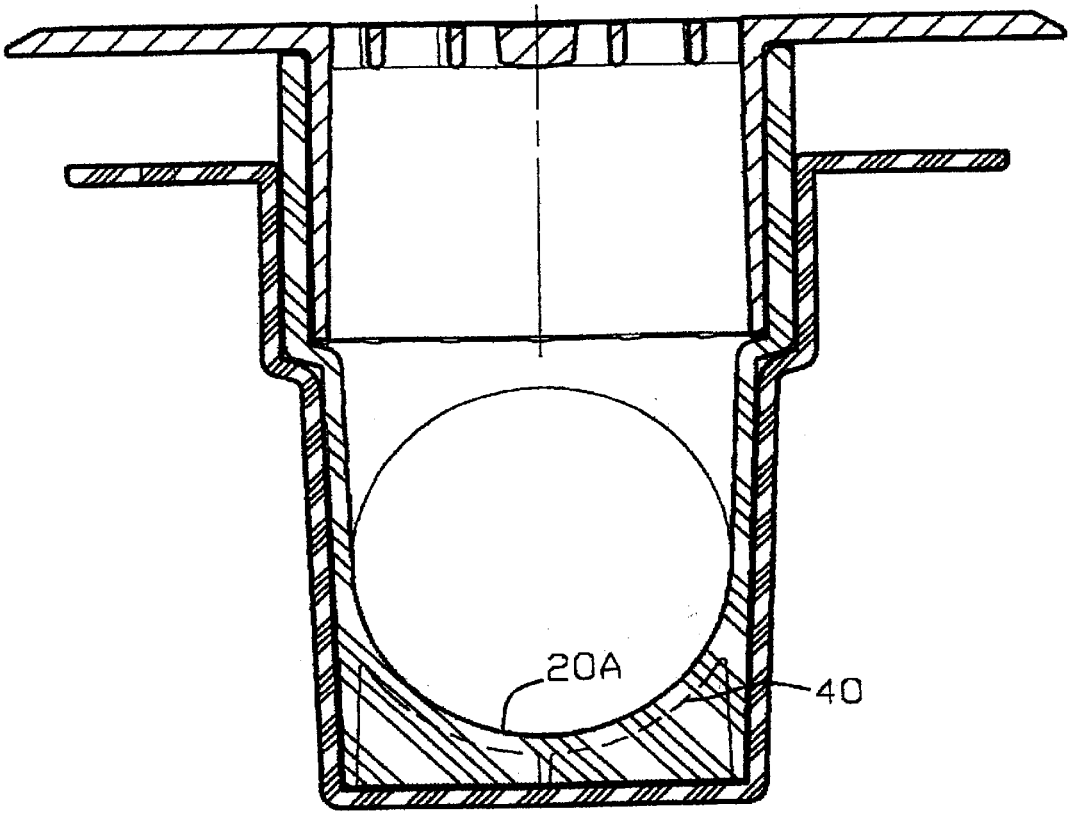
FIG. 4 is a cross sectional view along the lines A—A of FIG. 2.
Figure 5:
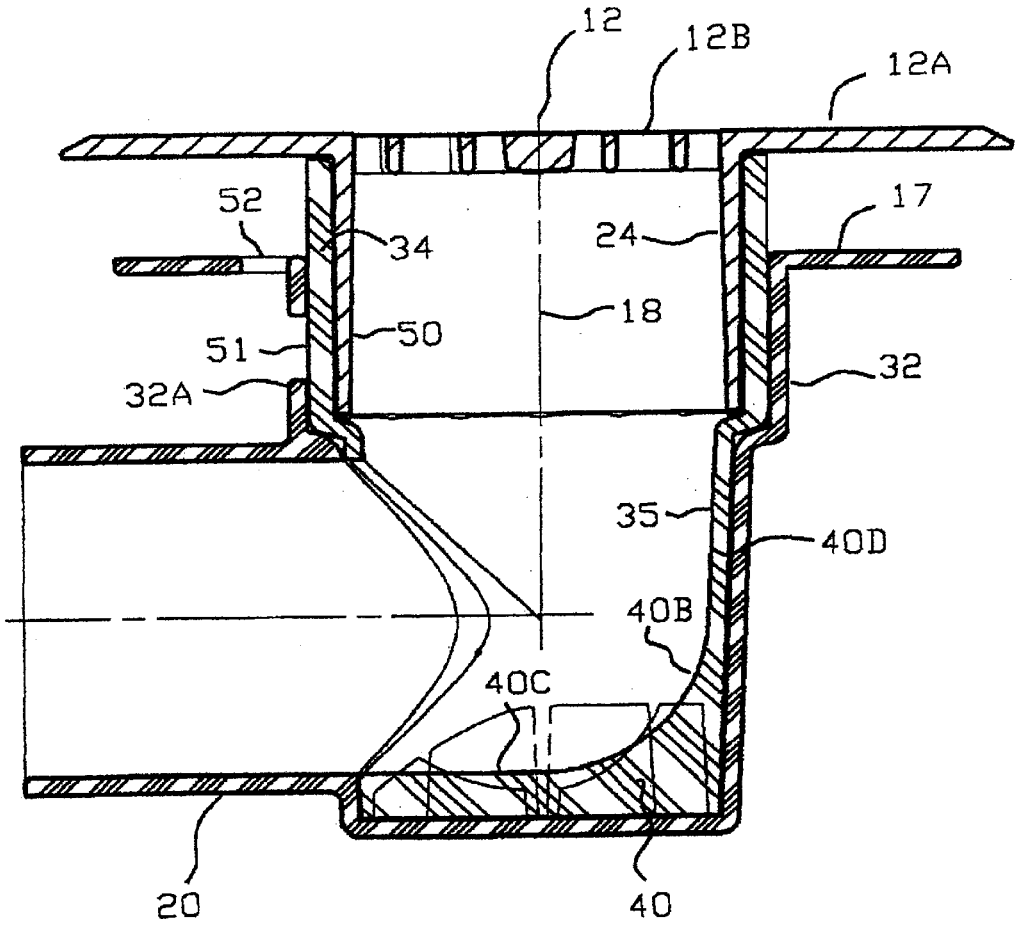
FIG. 5 is a cross sectional view along the lines B—B of FIG. 3.

In this embodiment, the bottom end of the sleeve is closed by a bottom end portion 40 which is molded with the wall 35. The bottom end portion 40 as best shown in FIGS. 4 and 5 provides a surface which is curved so as to match the bottom circular portion of the opening 20A so that air entering the housing through the opening 20A passes smoothly onto the surface defined by the bottom portion 40 as a continuation of the pipe surface. The bottom portion 40 is also curved as shown in FIG. 5 to define a semi-circular curved portion 40B which extends from the bottom surface portion of the inlet pipe 20 through 90° in a smooth curvature from a horizontal surface portion 40C at the inlet pipe to a vertical portion 40D at the wall 35. Thus the air entering from the inlet pipe is smoothly curved to move from a horizontal direction at the inlet pipe to a vertical direction along the axis 18 to the perforated vent area 12B of the vent plate 12.

The outside surface of the collar 24 carries a plurality of ribs 24A which co-operate with grooves 34A in the wall 34 so as to act as a friction fit by which rotation of the vent plate 12 causes rotation of the sleeve 14. However the vent plate can be pulled out of the sleeve, rotated relative to the sleeve and reinserted so as to change the angular orientation with the grooves and ribs being arranged to locate and hold the angular orientation once set. This can be used to adjust the angular position of the vent openings of the vent area 12B relative to the location of the opening 20A so as to direct the air in the required position into the space.

Figure 6:
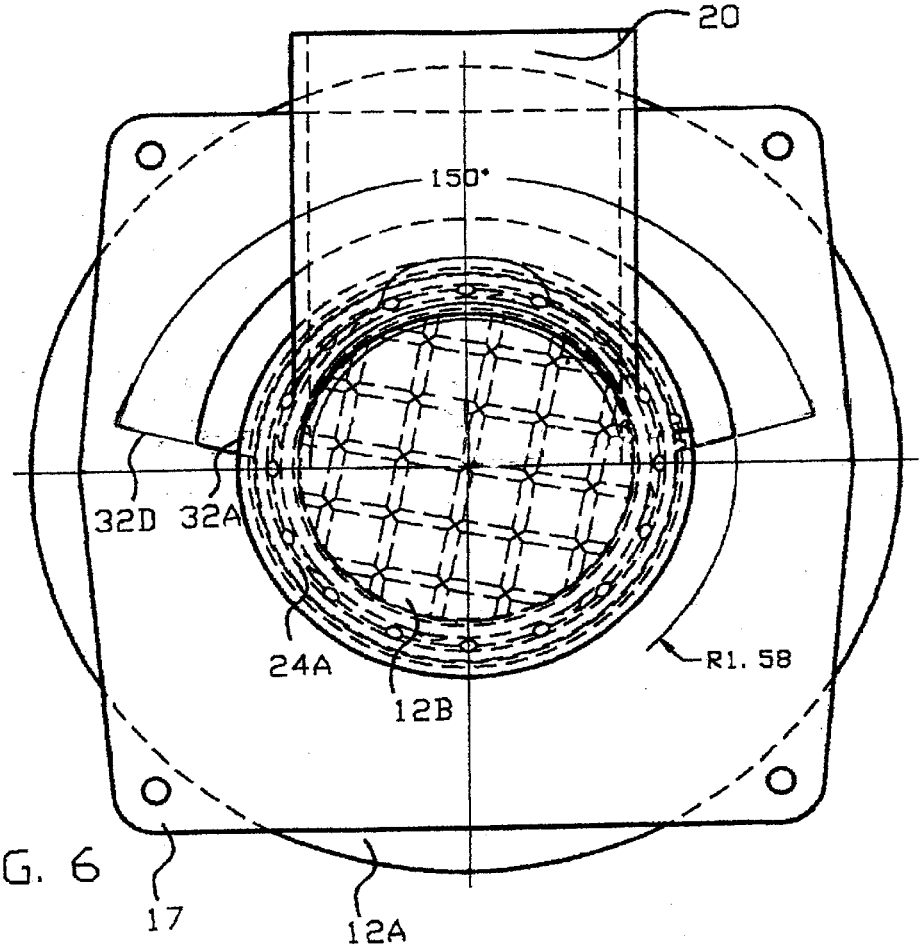
FIG. 6 is a top plan view partly in phantom of the second embodiment of the invention.

A notch 50 provided on the outside surface of the wall 34 as best shown in FIG. 5 engages into a slot 32A in the wall 32 of the housing when the sleeve is inserted into the housing to the required position. The notch 50 includes a horizontal upper surface which resists the sleeve being pulled back out of the housing together with a chamfered or inclined lower surface 51 which allows the sleeve to be simply popped into place by pressure downwards into the housing. A relieving slot 52 in the flange 17 allows the portion of the wall 32 at the slot 32A to flex outwardly to allow the notch 50 to pass. The slot 32A extends around an angle of the order of 150° as shown at 32B in FIG. 6. The notch 50 and the slot 32A thus limits the angular rotation of the sleeve relative to the housing and thus limits the angular rotation of the vent plate.

While one embodiment of the present invention has been described in the foregoing, it is to be understood that other embodiments are possible within the scope of the invention. The invention is to be considered limited solely by the scope of the appended claims.

What is claimed is:

1. A termination receptacle for an air supply duct comprising:

a housing having a wall surrounding an axis of the housing;

an inlet pipe arranged for connection to the air supply duct for receiving air therefrom;

the inlet pipe being connected to the wall of the housing generally at right angles to the axis so as to communicate the air from the duct through an opening in the wall into the housing;

the housing having one end closed and an opposed open end such that the air supplied into the housing passes from the housing through the open end;

the housing having a mounting flange member at the open end for attachment of the housing to a mounting surface such that the axis is generally at right angles to the mounting surface;

a damper sleeve member having an open discharge end and an insertion portion extending from the discharge end and arranged for insertion into the open end of the housing for receiving the air therefrom a vent plate member;

the vent plate member having a plate portion with a central perforated discharge area which is perforated for the passage of air therethrough and a peripheral surrounding flange;

the vent plate member having a projecting connecting portion extending from the plate portion generally at right angles to the plate portion for connecting the vent plate member to the damper sleeve member at the open end thereof for communication of the air from the housing through the damper sleeve member and through the central perforated discharge area;

the connecting portion and the damper sleeve member being arranged such that the vent plate member is maintained attached thereto with the plate portion generally at right angles to the axis so as to lie parallel to the mounting surface on a side thereof opposite to the mounting flange member;

the connecting portion and the damper sleeve member being arranged such that rotation of the vent plate member about the axis causes common rotation of the damper sleeve member about the axis therewith;

the wall of the housing defining at least a portion thereof at the opening which is circular cylindrical at least partly surrounding the axis;

the insertion portion of the damper sleeve member being arranged to rotate around the axis with rotation of the damper sleeve member and being shaped to cooperate with the circular cylindrical portion of the housing to move gradually between a first position in which the opening is fully exposed by the insertion portion allowing passage of air from the inlet through the full area of the opening into the housing and a second position in which the insertion portion fully covers the opening thus closing off flow of air through the opening into the housing such that the insertion portion acts as a damper.

2. The termination receptacle according to claim 1 wherein the insertion portion includes a circular cylindrical wall portion at the circular cylindrical portion of the housing.

3. The termination receptacle according to claim 2 wherein the insertion portion has an outer surface in sliding fit with an inner surface of the circular cylindrical portion of the housing.

4. The termination receptacle according to claim 1 wherein insertion portion is substantially circular cylindrical in shape with a cut out at the opening.

5. The termination receptacle according to claim 1 wherein the insertion portion extends substantially to the bottom of the housing.

6. The termination receptacle according to claim 1 wherein the inlet pipe is of smaller cross sectional area than the housing.

7. The termination receptacle according to claim 1 wherein the vent plate member and the damper sleeve member are separate and connected by cooperating elements arranged to allow adjustment of the angular position of the vent member relative to the damper sleeve member.

8. The termination receptacle according to claim 1 wherein the damper sleeve member includes an interconnecting element for holding the damper sleeve member in the housing.

9. The termination receptacle according to claim 1 wherein the housing has a depth between the flange member and the bottom which is no greater than 3.5 inches.

10. The termination receptacle according to claim 1 wherein the damper sleeve member includes two axially spaced cylindrical portions defining a shoulder therebetween.

11. The termination receptacle according to claim 1 wherein the damper sleeve member includes an outwardly projecting tab on an outer surface thereof for projecting into an annular locating slot on the housing.

12. The termination receptacle according to claim 1 wherein the vent plate member and the damper sleeve member are separate and connected by cooperating elements which comprise longitudinally extending ribs and grooves.

13. The termination receptacle according to claim 1 wherein the insertion portion of the damper sleeve member includes a closed end at the closed end of the housing.

14. The termination receptacle according to claim 13 wherein the closed bottom end is shaped to provide a smooth guide surface at the opening to guide air from the inlet pipe to turn through ninety degrees to flow axially along the housing.

15. A termination receptacle for an air supply duct comprising:

a housing having a wall surrounding an axis of the housing;

an inlet pipe arranged for connection to the air supply duct for receiving air therefrom;

the inlet pipe being connected to the wall of the housing generally at right angles to the axis so as to communicate the air from the duct through an opening in the wall into the housing;

the housing having one end closed and an opposed open end such that the air supplied into the housing passes from the housing through the open end;

the housing having a mounting flange member at the open end for attachment of the housing to a mounting surface such that the axis is generally at right angles to the mounting surface;

a damper sleeve member having an open discharge end and an insertion portion extending from the discharge end and arranged for insertion into the open end of the housing for receiving the air therefrom the wall of the housing defining at least a portion thereof at the opening which is circular cylindrical at least partly surrounding the axis;

the insertion portion of the damper sleeve member being arranged to rotate around the axis and being shaped to cooperate with the circular cylindrical portion of the housing to move gradually between a first position in which the opening is fully exposed by the insertion portion allowing passage of air from the inlet through the full area of the opening into the housing and a second position in which the insertion portion fully covers the opening thus closing off flow of air through the opening into the housing such that the insertion portion acts as a damper.

16. The termination receptacle according to claim 15 wherein the insertion portion includes a circular cylindrical wall portion at the circular cylindrical portion of the housing.

17. The termination receptacle according to claim 16 wherein the insertion portion has an outer surface in sliding fit with an inner surface of the circular cylindrical portion of the housing.

18. The termination receptacle according to claim 15 wherein insertion portion is substantially circular cylindrical in shape with a cut out at the opening.

19. The termination receptacle according to claim 15 wherein the insertion portion extends substantially to the bottom of the housing.

20. The termination receptacle according to claim 15 wherein the inlet pipe is of smaller cross sectional area than the housing.

21. The termination receptacle according to claim 15 wherein the insertion portion of the damper sleeve member includes a closed end at the closed end of the housing.

22. The termination receptacle according to claim 21 wherein the closed bottom end is shaped to provide a smooth guide surface at the opening to guide air from the inlet pipe to turn through ninety degrees to flow axially along the housing.

* * * * *